US007093602B1

(12) United States Patent
Edwards

(10) Patent No.: US 7,093,602 B1
(45) Date of Patent: Aug. 22, 2006

(54) BEAUTY CAP

(76) Inventor: Rosa Edwards, 16102 Biltmore, Detroit, MI (US) 48235

( * ) Notice: Subject to any disclaimer, the term of this patent is extended or adjusted under 35 U.S.C. 154(b) by 66 days.

(21) Appl. No.: 10/912,300

(22) Filed: Aug. 6, 2004

(51) Int. Cl.
*A41G 3/00* (2006.01)

(52) U.S. Cl. ..... 132/53; 434/94

(58) Field of Classification Search ..... 132/53–55; 2/209.13, 171, 209.14; 434/94, 399; D28/10, D28/92–93
See application file for complete search history.

(56) References Cited

U.S. PATENT DOCUMENTS 3,199,516 A * 8/1965 Frishman ..... 132/201
3,340,880 A * 9/1967 Gresham et al. ..... 132/260
3,460,546 A * 8/1969 Abbott ..... 132/53
3,688,779 A * 9/1972 Greco ..... 132/53
4,492,242 A * 1/1985 Dalton ..... 132/53
4,599,749 A * 7/1986 Childs et al. ..... 2/204
4,804,003 A * 2/1989 Moen ..... 132/53
6,283,128 B1 * 9/2001 Saxton ..... 132/246

* cited by examiner

*Primary Examiner*—Todd E. Manahan
*Assistant Examiner*—Rachel Running
(74) *Attorney, Agent, or Firm*—Charles W. Chandler

(57) ABSTRACT

A beauty cap has a plurality of sponge rollers, and a strip of material simulating hair wrapped around each roller and attached to the cap to simulate a user having her hair wrapped in curlers.

5 Claims, 1 Drawing Sheet

BEAUTY CAP

BACKGROUND AND SUMMARY OF THE INVENTION

This invention is related to hair coverings, and more particularly to a cap worn by a user to simulate the user's hair being wrapped in rollers. The user may be a busy mother who has to leave her house in a hurry, a mother convalescing from childbirth, or a cancer patient waiting for new growth of hair and who does not desire to wear a full wig.

The preferred embodiment of the invention comprises a cap formed of an outer layer of and an inner layer of nylon material of a soft cotton fabric. An elastic band is stitched around the border of the cap to assist in retaining it on the user's head.

A plurality of soft sponge rollers are each covered with a cloth simulating natural hair. The simulated hair is attached to the outside surface of the cap in a suitable arrangement. Each roller is connected to its wrapping by a conventional clip, commonly used to retain hair on a roller.

The simulated hair may be chosen of a selected color, such as grey, black, off-black, brown, red, brunette or blond. Various ornamental accessories may be attached to the rollers, such as a long sash tied either in the front or the back, fake bangs mounted in the front to cover part of the forehead or the nap of the neck and having the same color as the simulated hair.

Still further objects and advantages of the invention will become readily apparent to those skilled in the art to which the invention pertains upon reference to following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
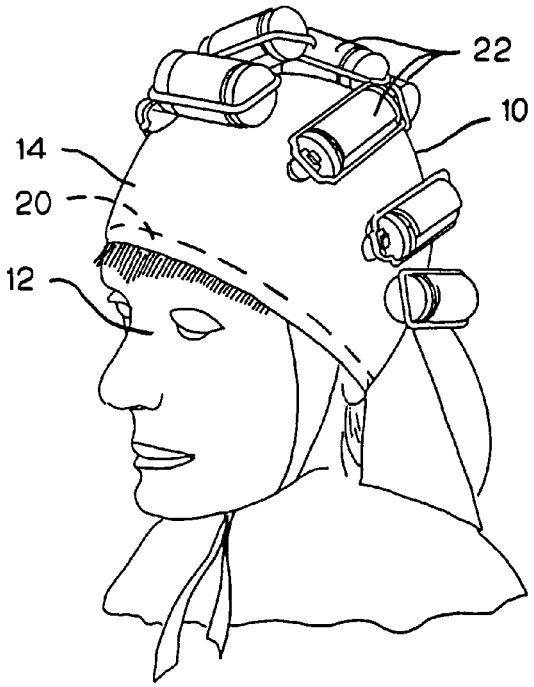
FIG. 1 is a perspective view of a user wearing a head covering illustrating the preferred embodiment of the invention.
Figure 3:
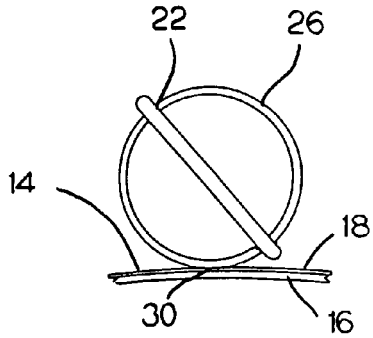
FIG. 3 is a view seen from the left side of FIG. 2.
Figure 2:
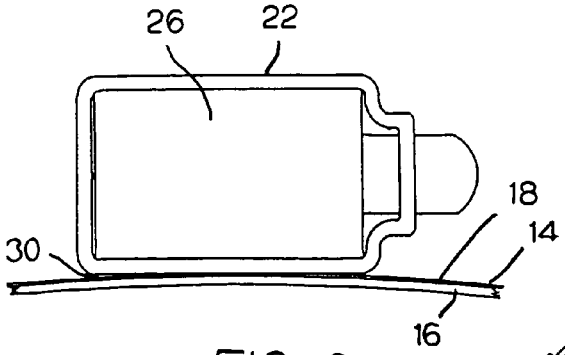
FIG. 2 is an enlarged sectional view of a typical roller attached to the cap.
Figure 4:
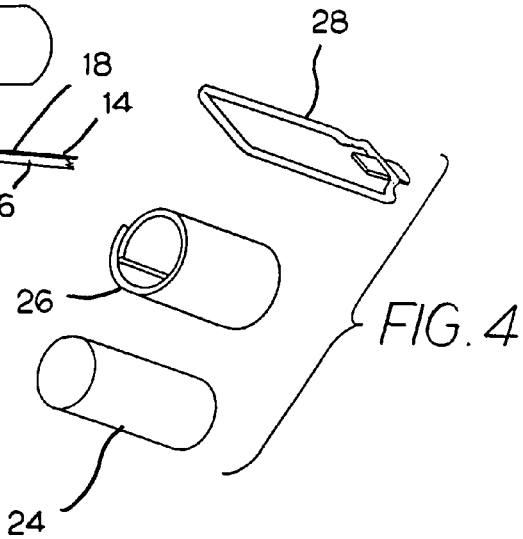
FIG. 4 is an exploded view of the cap, roller and clip.

Referring to the drawings, a preferred head covering 10 is mounted on the head of a user 12. Head covering 10 comprises a cap 14 having an outer layer 16 of a porous nylon and an inner layer 16 of a soft cotton material attached to an outer cover 18 preferably formed of nylon. The two materials are sewn together and attached to an elastic band 20 which assists in retaining the cap on the user's head. The cap has a shape adapted to conform to the user's head. Outer layer 16 does not have any hair strands.

A plurality of simulated hair rollers 22 are mounted in a suitable 20 arrangement on the outside surface of the cap. Each simulated roller 22 comprises a sponge body 24 having a cylindrical outer surface, an outer swatch 26, and a conventional clip 28. For illustrative purposes, each body 23 is about 2¼" long and has a diameter of 1⅜" formed of a pink compressible resilient sponge material.

Each swatch 26 is formed of a suitable cotton material, which for example may be about 1¾" wide and long enough to be wrapped around its roller and then stitched as at 30 to cover 18. The color of the swatch is chosen according to the desires of the user.

Clip 28 may be any conventional clip used for rollers.

I claim:

1. A beauty cap, comprising:

a cap of a flexible porous fabric having a size and shape to conform to and to be worn on the head of a user, said cap having an outer surface with no hair strands affixed thereto and an inner surface concealing from view the portion of the head of the user covered by the cap;

a soft, resilient roller;

a strip of fabric, said strip of fabric is a cloth material having a color of human hair, wrapped around the roller, the strip of fabric being attached to the outer surface of the cap, wherein said cloth material having a substantial width so as to not simulate a single strand of natural hair; and a clip mounted on the roller and the strip of fabric to retain the strip of fabric in the wrapped condition.

2. A cap as defined in claim 1, in which the roller is formed of a sponge material.

3. A cap as defined in claim 1, including an elastic band attached around the perimeter of the cap to assist in retaining the cap on the user's head.

4. A cap as defined in claim 1, including a plurality of other resilient rollers, and a strip of a fabric wrapped around each of said other rollers.

5. A beauty cap, comprising:

a cap of a flexible porous fabric having a size and shape to conform to and to be worn on the head of a user, said cap having an outer surface with no hair strands affixed thereto and an inner surface concealing from view the portion of the head of the user covered by the cap;

a soft, resilient roller; and a strip of fabric simulating the appearance of a swatch of hair, wherein said strip of fabric has substantial width as to not simulate a single strand of natural hair, said strip being wrapped around the roller and being attached to the outer surface of the cap.

* * * * *